US006227551B1

(12) United States Patent
Roy

(10) Patent No.: US 6,227,551 B1
(45) Date of Patent: May 8, 2001

(54) IN-LINE ROLLER SKATE WITH ECCENTRICALLY PIVOT WHEEL FRAMES

(75) Inventor: Albert Roy, St-Anselme (CA)

(73) Assignee: 9084-6593 Quebec Inc., Beauce-Nord (CA)

( * ) Notice: Subject to any disclaimer, the term of this patent is extended or adjusted under 35 U.S.C. 154(b) by 0 days.

(21) Appl. No.: 09/326,799

(22) Filed: Jun. 4, 1999

(51) Int. Cl.[7] ..... A63C 1/00; A63C 17/00

(52) U.S. Cl. ..... 280/11.223; 280/11.27

(58) Field of Search ..... 280/11.204, 11.206, 280/11.217, 11.27, 11.223, 11.231, 11.233

(56) References Cited

U.S. PATENT DOCUMENTS

| | | | | |
|---|---|---|---|---|
| 1,866,134 | * | 7/1932 | Smith | 280/11.223 |
| 4,272,090 | * | 6/1981 | Wheat | 280/11.231 |
| 5,135,244 | | 8/1992 | Allison . | |
| 5,342,071 | | 8/1994 | Soo . | |
| 5,390,958 | | 2/1995 | Soo . | |
| 5,405,156 | | 4/1995 | Gonella . | |
| 5,462,297 | | 10/1995 | Lee . | |
| 5,484,149 | | 1/1996 | Lee . | |
| 5,551,711 | | 9/1996 | Mangelsdorf . | |
| 5,634,648 | | 6/1997 | Tonel et al. . | |
| 5,690,344 | | 11/1997 | Chen . | |
| 5,755,449 | * | 5/1998 | Pozzobon | 280/11.231 |
| 5,769,433 | * | 6/1998 | Zorzi et al. | 280/11.231 |
| 5,785,326 | * | 7/1998 | Chang | 280/11.217 |
| 5,938,213 | * | 8/1999 | Gignoux | 280/11.231 |
| 5,997,014 | * | 12/1999 | Ellis et al. | 280/11.231 |
| 6,065,761 | * | 5/2000 | Gignoux et al. | 280/11.231 |
| 6,073,941 | * | 6/2000 | Hilgarth | 280/11.27 |
| 6,098,997 | * | 8/2000 | Cheng | 280/11.27 |

* cited by examiner

*Primary Examiner*—Brian L. Johnson
*Assistant Examiner*—Joselynn Sliteris
(74) *Attorney, Agent, or Firm*—Ronald S. Kosie; Robert Brouillette

(57) ABSTRACT

A wheel frame for use with in-line roller skates, and in particular, in-line roller skates with eccentrically mounted, single pivot wheel frames. The eccentrically mounted frame is configured such that the moment arm of the front wheel about the pivot point of the frame is greater than the moment arm of the rear wheel about the pivot point.

4 Claims, 6 Drawing Sheets

IN-LINE ROLLER SKATE WITH ECCENTRICALLY PIVOT WHEEL FRAMES

BACKGROUND OF THE INVENTION

The present invention relates to a wheel frame for use with in-line roller skates, and in particular, relates to in-line roller skates with eccentrically mounted, single pivot wheel frames.

Wheel frames, or mounts of in-line roller skates are well known in the art, for example U.S. Pat. No. 5,690,344 to Kim Chen, U.S. Pat. No. 5,634,648 to Tonel, et al., U.S. Pat. No. 5,405,156 to Gonella, U.S. Pat. No. 5,390,958 to Soo, U.S. Pat. No. 5,342,071 to Soo. However, the in-line skates of the prior art, and their wheel frames, are not particularly adapted to providing with increased manoeuverability, flexibility and ease of ride. In particular, the prior art does not provide for a wheel frame which allows a first or front wheel to be raised, or rotated upwardly in order to overcome (i.e. ride over) an obstacle such as a rock, twig or other such obstacles. The patents which allow for a front wheel to be raised upwardly however, are provided with wheel frames which are pivoted about two or more pivot points, therefore, needlessly complicating the construction of the wheel frame, adding unnecessary costs, and unnecessary weight to the skate. Further, single pivot wheel frames disclosed in the prior art are not eccentrically mounted about their pivot point, and therefore do not make use of the mechanical advantage which may result from eccentrically mounted wheels.

Therefore, it is an object of the present invention to provide for an improved in-line roller skate having improved wheel frames.

It is a further object of the present invention to provide for an in-line roller skate with eccentrically mounted wheel frames in order to facilitate the use of the in-line roller skate over rough or uneven train.

It is a further object of the present invention to provide for an in-line roller skate with eccentrically mounted, single pivot, wheel frames in order to facilitate the use of the in-line roller skate over rough or uneven train.

It is a further object of the present invention to provide for an in-line roller skate with eccentrically mounted, single pivot, wheel frames in order to increase the manoeuverability of the skate.

It is a further object of the present invention to provide for an improved in-line roller skate wheel frame of more economical construction.

SUMMARY OF THE INVENTION

In accordance with a general embodiment of the present invention, there is provided for:

an in-line roller skate comprising
- a boot
- at least one wheel frame comprising at least two wheels rotatably mounted on said wheel frame
- wherein said at least one wheel frame is eccentrically, pivotally mounted to said boot.

In accordance with a further aspect, there is provided for an:

in-line roller skate comprising
- a boot
  - a sole plate affixed to said boot
- a first wheel frame having a front wheel and a rear wheel rotatably mounted thereon
- a second wheel frame having a front wheel and a rear wheel rotatably mounted thereon wherein said first wheel frame is eccentrically, pivotally mounted to said sole plate at a first single pivot point, such that the moment arm of the front wheel about said first pivot point is greater than the moment arm of the rear wheel about said first pivot point, and wherein said second wheel frame is eccentrically, pivotally mounted to said sole plate at a second single pivot point, such that the moment arm of the front wheel about said second pivot point is greater than the moment arm of the rear wheel about said second pivot point.

In accordance with a further aspect, there is provided for a:

wheel frame suitable for pivotable mounting to an in-line roller skate about a single pivot point comprising at least a forward rotational axis and a rear rotational axis for rotatably mounting a wheel thereon, wherein the distance from the forward rotational axis to said pivot point is greater than the distance from the rear rotational axis to said pivot point.

In accordance with an aspect of the present invention, there is provided for an in-line roller skate comprising a boot onto which a sole plate may be affixed. Said sole plate may be permanently affixed to the underside of the boot or may be removably affixed to the boot. Further, at least one wheel frame may be pivotally mounted onto said sole plate, and two or more wheels may be rotatably affixed to said wheel frame. There may be provided with only one wheel frame which may be pivotally mounted to the sole plate or, alternatively two or more wheel frames may be pivotally mounted onto said sole plate. Further, in accordance with another aspect, the in-line roller skate may be provided with one ore more wheel frames pivotally mounted directly to the boot (i.e. to te underside of the boot), therefore obviating the need for a sole plate or other intermediate structure between the wheel frame(s) and the boot.

In accordance with a particular aspect of the present invention, an in-line skate may be provided with two or more wheel frames, i.e. a forward wheel frame and a rear wheel frame, each pivotally mounted to a sole plate. Each wheel frame may comprise two wheels rotatably mounted thereon, the wheels being of conventional construction. Thus, in accordance with this embodiment, the in-line roller skate may comprise four wheels wherein the first two may be rotatably mounted onto a forward wheel frame. The third and fourth wheels may be mounted onto a rear wheel frame. One and/or both of the wheel frames may be eccentrically, pivotally mounted to the sole plate. Alternatively, only one of the wheel frames may be eccentrically mounted to the sole plate, for example, the forward wheel frame, while the rear wheel frame may be conventionally mounted, or for example, the forward wheel frame may be conventionally mounted to the sole plate while the rear wheel frame is eccentrically pivotally mounted to the sole plate.

In accordance with a particular embodiment, the present invention provides for a in-line roller skate comprising a forward and a rear wheel frame each of which may be eccentrically, pivotally mounted to said sole plate (or directly to the boot) about a single pivot point. The expression eccentrically mounted is understood to mean that, with respect to a wheel frame, the axis of rotation of the front wheel and the axis of rotation of the rear wheel are not equidistant from the pivot point (i.e. the pivot axis) of the wheel frame. In other words, the pivot point of the wheel frame is located elsewhere than at the geometric centre of the wheel frame. For example, the distance (whether the straight line distance or the right angle distance) between the axis of rotation of the front wheel and the pivot point of the wheel frame may be greater (or smaller) than the distance between the axis of rotation of the rear wheel and the same pivot point. As may be understood, the pivot point of the wheel frame may be disposed behind the midpoint of the wheel frame (i.e. rearward of the mid point between the front wheel and the rear wheel), such that less force is required to vertically pivot the front wheel about the pivot point then would otherwise normally be required if the front and rear wheels were equidistant about the pivot point. The expression eccentrically mounted may further be understood to mean that the moment arm of the forward most wheel about the pivot point of the wheel frame is greater than the moment arm of the rear wheel about the pivot point of the wheel frame. In accordance with a further definition of eccentrically mounted, the centre of gravity of the wheel frame may be disposed forwardly of the single pivot point of a wheel frame.

The difference between the distance of the front and rear wheels to the pivot point may be termed the eccentricity of the wheel frame, which eccentricity may also be expressed in terms of a ratio of one distance over the other. The eccentricity of a wheel frame may vary according to operational constraints. For example, the eccentricity may be minor, such that the forward wheel is only slightly disposed forwardly, i.e. the ratio of the distances of the forward wheel and rear wheel may for example be 50.1 to 49.9. Alternatively, the eccentricity may be greater, for example 70 to 30. In accordance with a particular embodiment, the eccentricity of a wheel frame may be 54.8 to 45.2, or a ratio of 1.21. The purpose of having an eccentrically mounted wheel frame is to take advantage of the lever effect created about the pivot point of the wheel frame, i.e. the mechanical advantage that is created or gained by such eccentricity. As may be understood, there is a mechanical advantage that is achieved when a longer moment arm is used, therefore necessitating a smaller force in order to obtain the same result, i.e. enabling the front wheel to bridge an obstacle. If the moment arm of the forward wheel is longer than that of the rear wheel, a smaller force is required to cause the upward motion of the front wheel in order to overcome the obstacle in its path.

In accordance with a further aspect, a wheel frame may be rotatably fitted with more than two wheels, i.e. three wheels, and may still also be eccentrically, mounted about a single pivot point onto a sole plate or directly to a boot. In this embodiment, the distance from the forward most wheel to the pivot point may be greater than the distance from the rear most wheel to the pivot point. Further, the distance of the middle wheel to the pivot point may also be greater than the distance of the rear wheel to the pivot point.

In accordance with a further embodiment, the wheel frame may be configured such that the single pivot point of the wheel frame may be disposed intermediate the forward wheel and the rear wheel. Alternatively, the single pivot point of the wheel frame may be disposed behind i.e. rearward of the rear wheel.

BRIEF DESCRIPTION OF THE DRAWINGS

The forgoing an other features of the present invention may be more clearly understood from the following detailed description and the accompanying drawings in which.

DETAILED DESCRIPTION OF THE INVENTION

Figure 1:
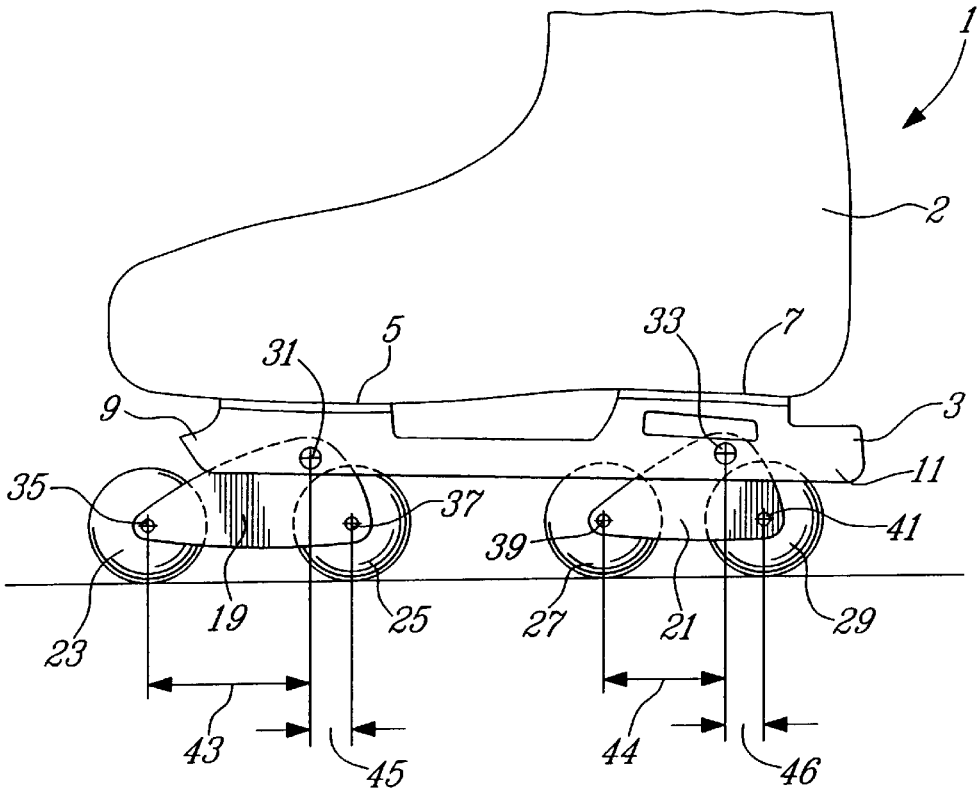
FIG. 1 is a schematic view of an in-line roller skate fitted with eccentrically mounted single pivot wheel frames.

With reference to FIG. 1, there is a illustrated in-line roller skate 1 fitted with eccentrically mounted, single pivot wheel frames 19 and 21. In-line roller skate 1 comprises a boot 2 which is fitted with a sole plate 3 at attachment points 5 and 7. Sole plate 3 comprises a forward most portion 9 and a rear most portion 11, and although sole plate 3 is shown as having a generally elongated shape, it is understood that sole plate 3 may be configured and disposed in any known manner. In-line roller skate 1 comprises forward wheel frame 19 and rear wheel frame 21, each of which is shown to be pivotally mounted to sole plate 3 by a single pivot 31 and 33 respectively. Said pivots 31 and 33 may for example comprise a pin disposed in a slot, not shown. Forward wheel frame 19 comprises two wheels 23 and 25 each rotatably disposed of forward frame 19 about rotation axis 35 and 37 respectively, through for example, a pin disposed in a slot. Rear wheel frame 21 is also shown fitted with two wheels 27 and 29 each of which is rotatably affixed to rear wheel frame 21 about rotation axis 39 and 4l, through for example, a pin disposed in a slot. Although forward wheel frame 19 and rear wheel frame 21 are shown to be substantially similar to each other, it is understood that they may be different one from the other, i.e. one may comprise more than two wheels, may not be pivotable, etc . . . .

Forward wheel frame 19 is configured and disposed to be pivotally mounted onto sole plate 3 about a single pivot axis 31. Further, the mounting of forward wheel frame 19 to said sole plate 3 is eccentric, namely that the right angle distance 43 from the axis of rotation of wheel 23 to the pivot point of forward frame 19 is greater than distance 45 from the axis of rotation of wheel 25 to the same pivot point 31. As shown, distance 43 is several times greater than distance 45, but it is understood that distance 43 may be only slightly larger than distance 45. Rear wheel frame 21 is configured and disposed similarly to forward wheel frame 19, with right angle distance 44 of wheel 27 about pivot point 33 being greater than the distance 46 of wheel 29 about pivot point 33. As shown in FIG. 1, distance 43 is equal to distance 44 and distance 45 is equal to distance 46 but it is understood that distance 43 may be greater than or less than distance 44 while distance 45 maybe greater than or less than distance 46. Each of the distances 43 and 45 may also be defined as the moment arm of wheels 23 and 25 respectively about pivot point 31, while each of the distances 44 and 46 may be defined to be the moment arm of wheels 27 and 29 respectively about pivot point 33.

Figure 2:
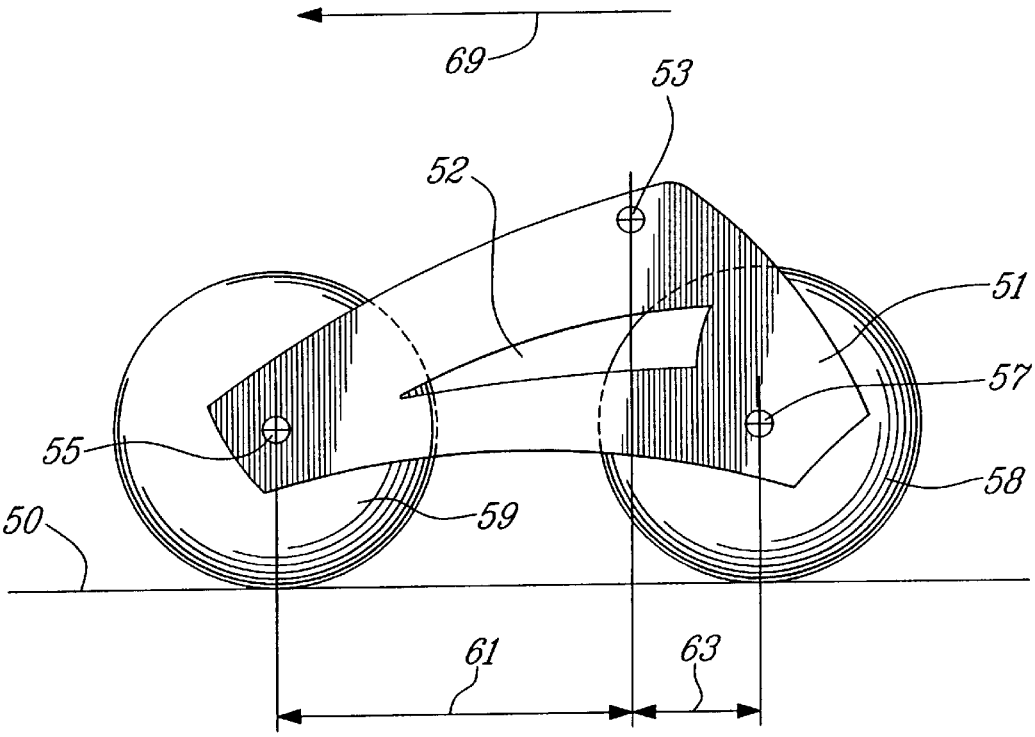
FIG. 2 is a closeup schematic view of an eccentrically mounted wheel frame.

FIG. 2 illustrates a closeup of an eccentrically mounted wheel frame 51 comprising wheels 59 and 58 rotatably mounted thereon. Wheel 59 is rotatably mounted on wheel frame 51 about axis 55 and rear wheel 58 is rotatably mounted to wheel frame 51 about axis 57. As shown, wheels 59 and 58 are touching the ground 50 and it is understood that the forward motion of travel of the wheel frame, and of the in-line roller skate 1 (not shown) is illustrated by motion arrow 69. As may be seen, the moment arm 61 of wheel 59 about pivot point 53 is greater than the moment arm 63 of wheel 58 about pivot point 53. Wheel frame 51 further comprises a weight saving cut-out portion 52 which may be configured in any known manner. Although shown as being generally triangular in shape, wheel frame 51 may be configured as desired or required.

Figure 3:
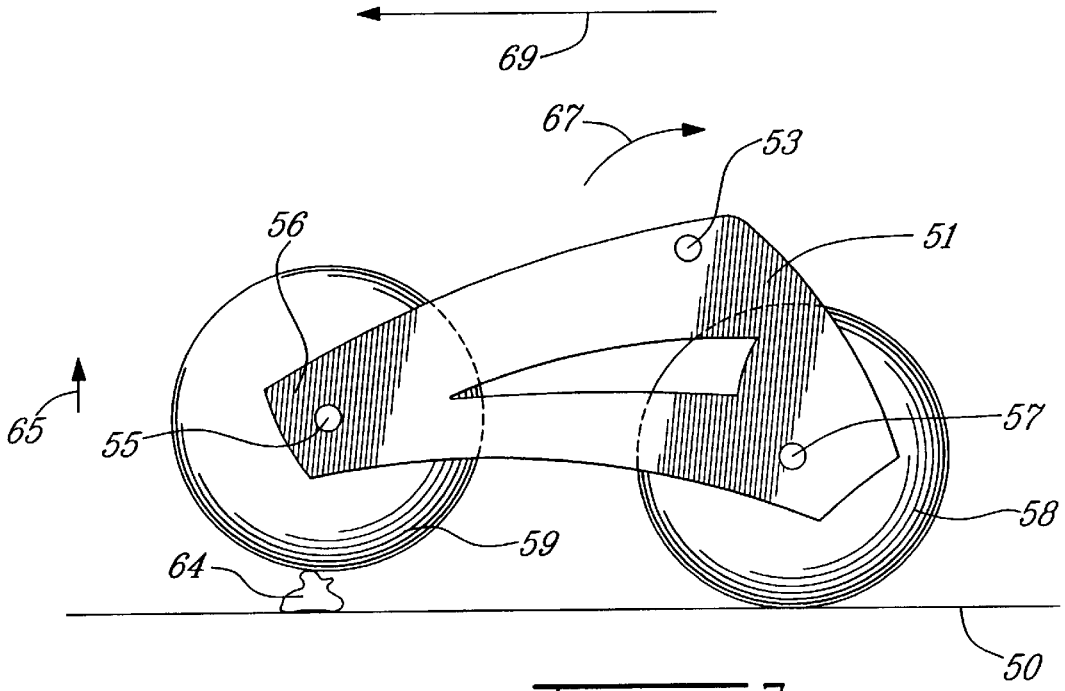
FIG. 3 is a schematic view of the wheel frame of FIG. 2 shown overcoming an obstacle in its path.

FIG. 3 illustrates the wheel frame 51 of FIG. 2 overcoming an obstacle 64 in the path of motion of the in-line roller skate. Roller skate 1 (not shown) moving in the direction of motion arrow 69, in attempting to overcome obstacle 64, will cause wheel 59, and the forward portion 56 of frame 51 to be displaced upwardly in the direction of motion arrow 65 and correspondingly, will cause wheel frame 51 to be pivoted about pivot point 53 in the direction of motion arrow 67. The eccentric mounting of wheel frame 51 about pivot point 53 creates a mechanical advantage which may facilitate said motion of the wheel frame 51, therefore reducing the force required to lift wheel 59 upwardly in the direction of motion arrow 65.

Figure 4:
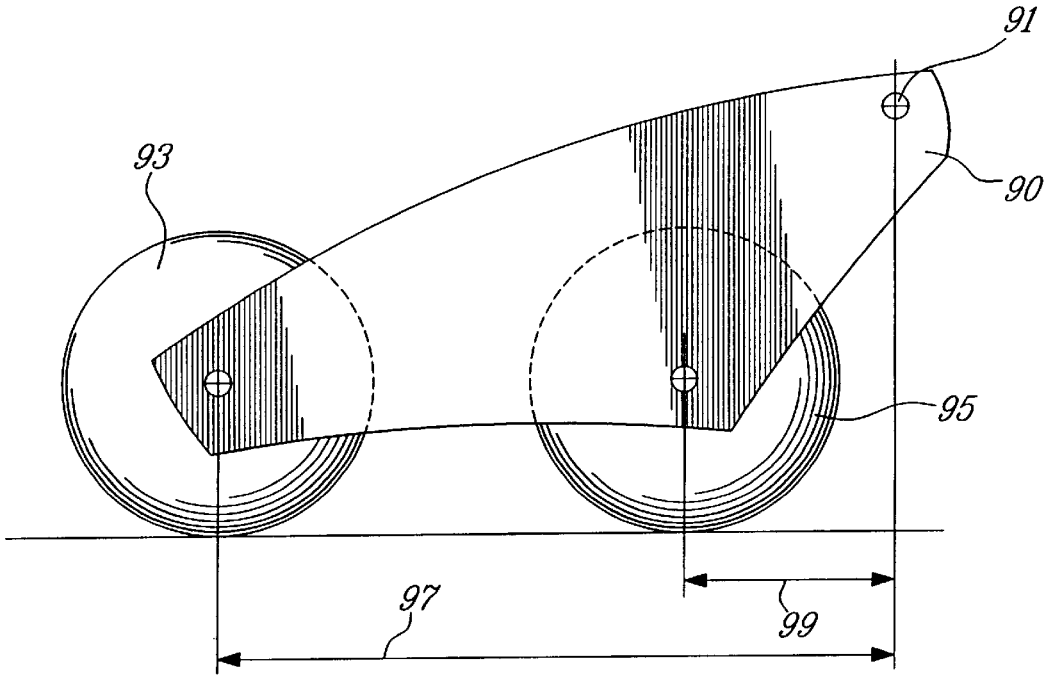
FIG. 4 is a schematic view of an alternative embodiment of an eccentrically mounted wheel frame.

FIG. 4 is an alternative embodiment of an eccentrically mounted wheel frame 90 comprising forward wheel 93 and rear wheel 95. In accordance with this embodiment, moment arm 97 of forward wheel 93 about pivot point 91 is greater than moment arm 99 of rear wheel 95 about pivot point 91, and pivot point 91 is disposed behind rearmost wheel 95.

Figure 5:
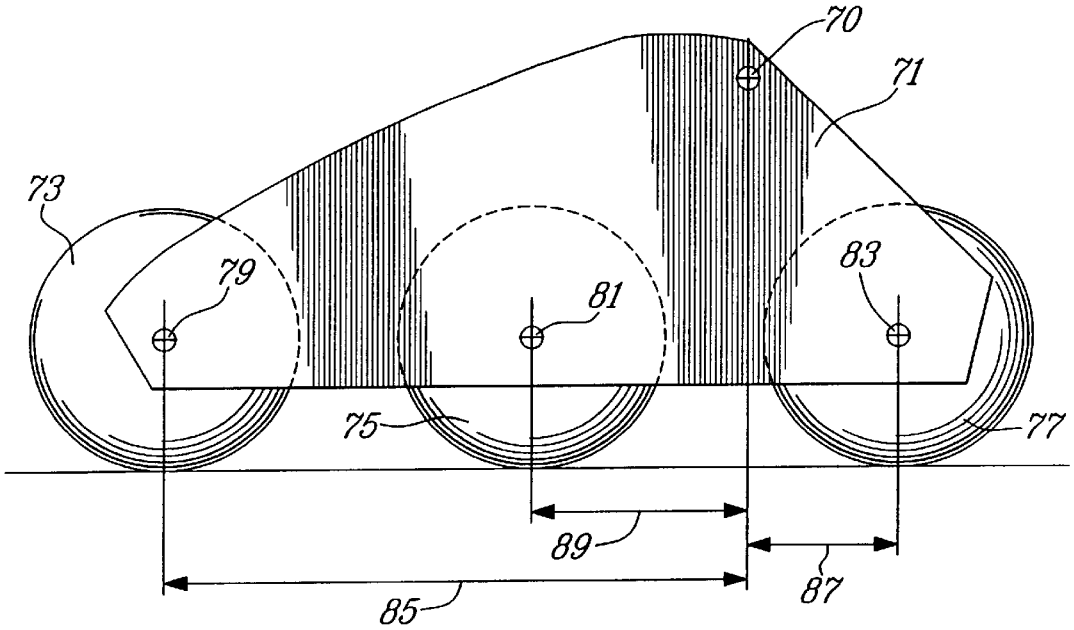
FIG. 5 is a schematic view of a further alternative embodiment of an eccentrically mounted wheel frame.

FIG. 5 is a schematic view of an alternative embodiment of an eccentrically mounted wheel frame 71. As shown, wheel frame 71 comprises a forward wheel 73, a middle wheel 75 and a rear wheel 77 rotatably mounted to the frame about rotation axis 79, 81 and 83 respectively. As shown, moment arm 85 of forward wheel 73 about pivot point 70 is greater than moment arm 87 of rear wheel 77 about a pivot point 70. Further, middle wheel 75 may be configured and disposed such that moment arm 89 of middle wheel 75 about pivot point 70 is greater than moment arm 87 of rear wheel 77.

Figure 6:
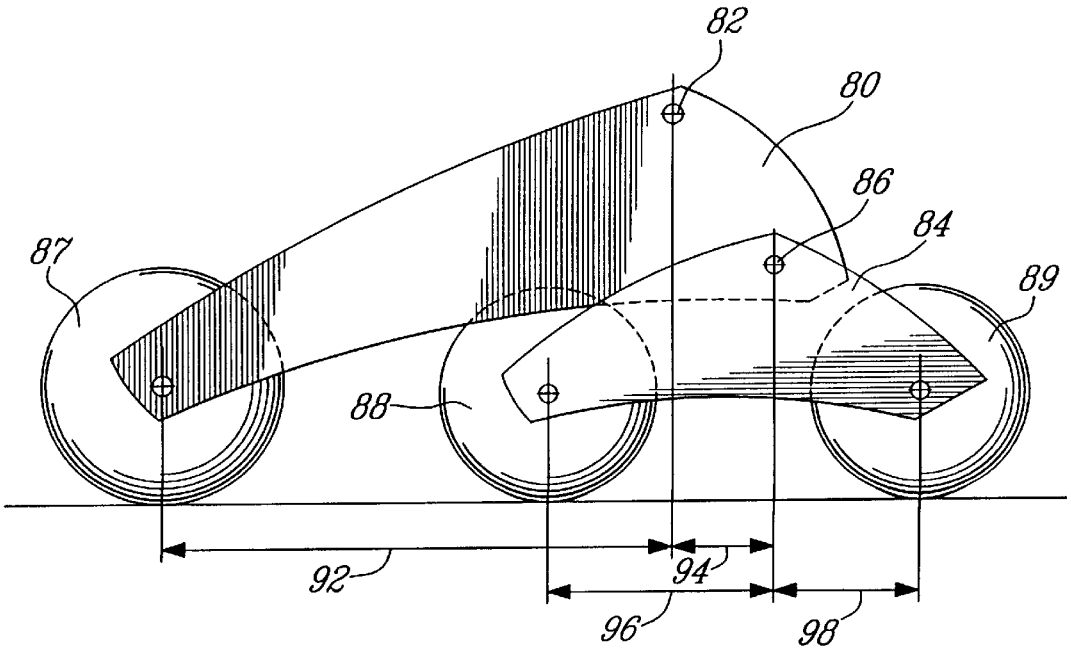
FIG. 6 is a schematic view of a further alternative embodiment of an eccentrically mounted wheel frame.

FIG. 6 is an alternative embodiment of an eccentrically mounted wheel frame 80 in accordance with the present invention. As illustrated, wheel frame 80 comprises in addition to forward wheel 87 a second wheel frame 84 pivotally mounted about pivot point 86. Second wheel frame 84 comprises wheels 88 and 89 rotatably mounted thereon. The moment arm 92 of forward wheel 87 is larger than the moment arm 94 of pivot point 86 about pivot point 82. Further, second wheel frame 84 is configured and disposed such that moment arm 96 of wheel 88 about pivot point 86 is greater than moment arm 98 of wheel 89 about pivot 86.

Figure 7:
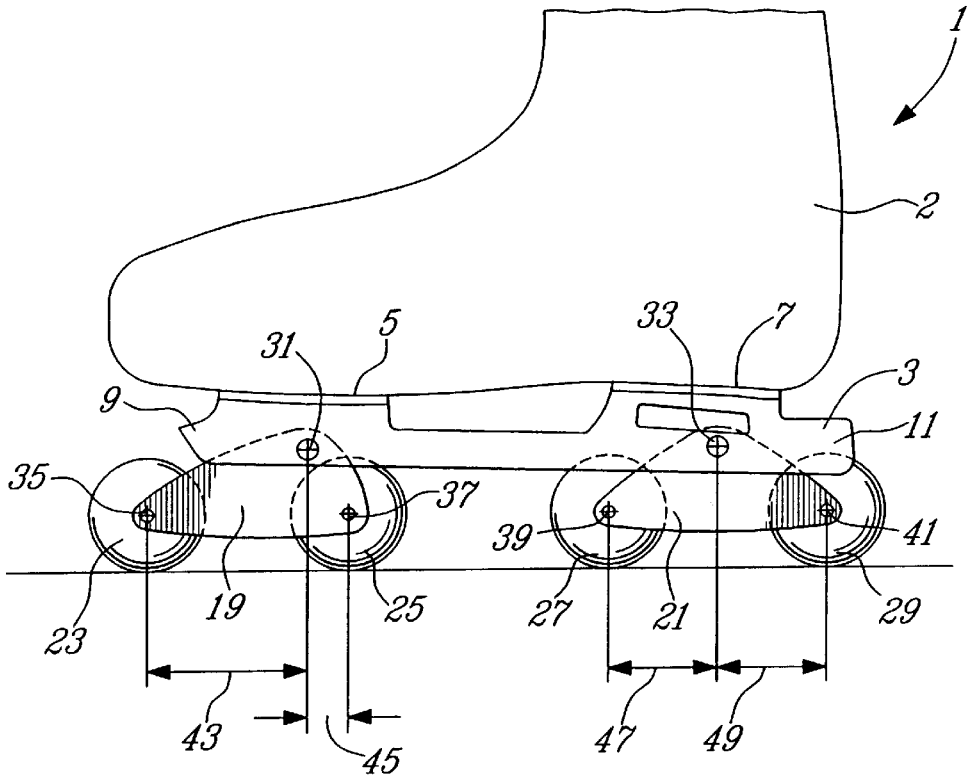
FIG. 7 is an alternative embodiment of an in-line skate having an eccentrically mounted wheel frame and a conventionally mounted wheel frame.

FIG. 7 is an alternative embodiment of an in-line skate 1 having an eccentrically mounted wheel frame 19 and a conventionally mounted wheel frame 21. As shown, moment arm 47 of wheel 27 about pivot point 33 is equal to moment arm 49 of wheel 29 about pivot point 33. Alternatively, moment arm 43 of front wheel 23 about pivot point 31 is greater than moment arm 45 of wheel 25 about pivot point 31.

Figure 8:
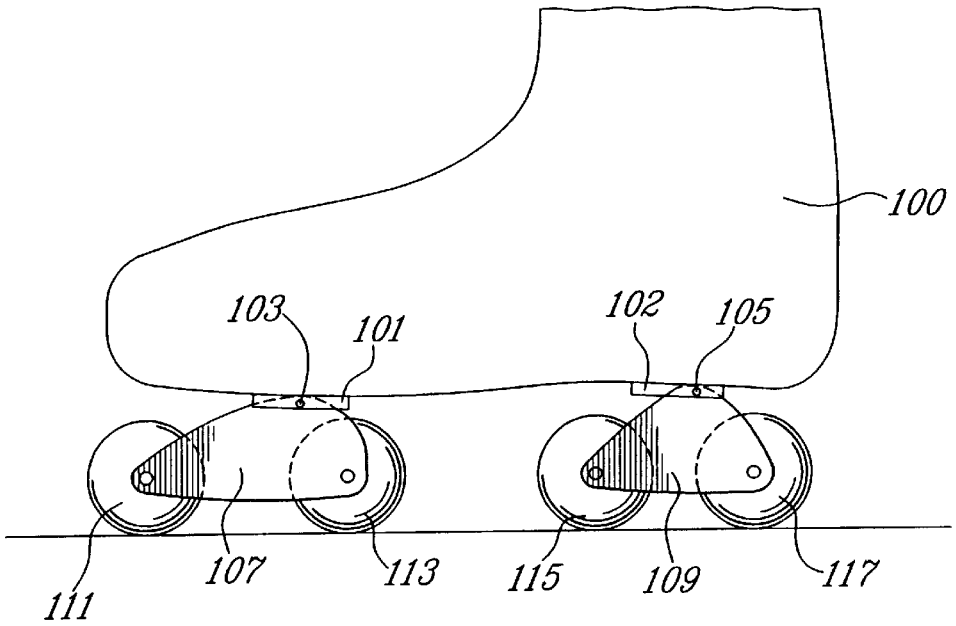
FIG. 8 is an alternative embodiment of an in-line roller skate.

FIG. 8 is an alternative embodiment of an in-line roller skate 100 wherein wheel frame 107 equipped with wheels 111 and 113 and wheel frame 109 equipped with wheels 115 and 117 are affixed directly to the boot via attachment point 101 and 102. As shown, wheel frame 107 and 109 are eccentrically mounted about a single pivot point 103 and 105 respectively.

Figure 9:
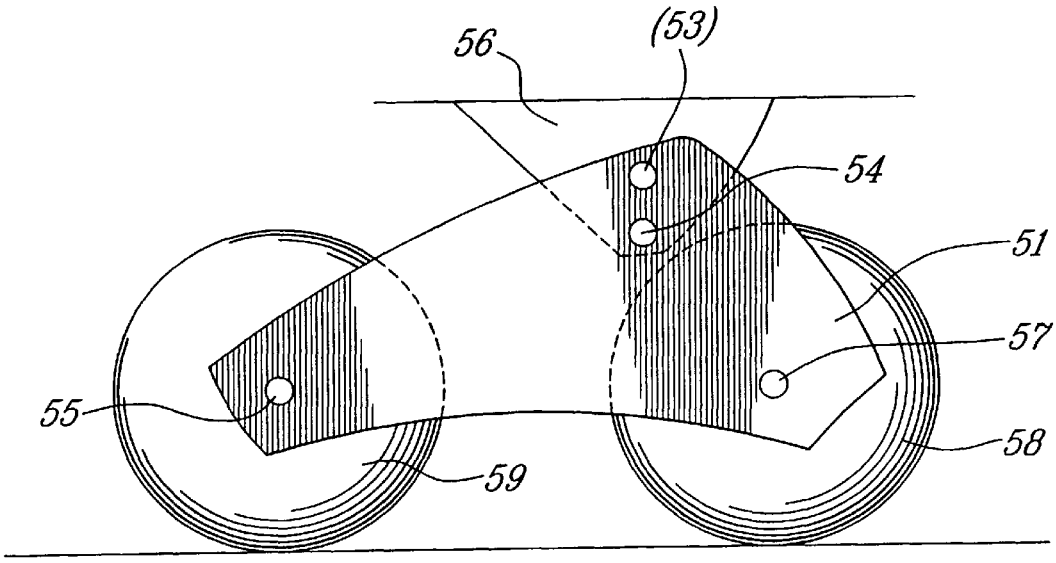
FIG. 9 is an alternative embodiment of the eccentrically mounted wheel frame of FIG. 2.

FIG. 9 is an alternative embodiment of the eccentrically mounted wheel frame 51 as shown in FIG. 2. As may be seen, the pivot point (pivot axis) 54 has been lowered in comparison to the pivot point 53 (shown in brackets) of the embodiment of FIG. 2. The lowering of the pivot point 54 provides a further mechanical advantage, as the closer pivot point 54 is to the imaginary line drawn between axis 55 and 57, the easier it is for wheel frame 51 to pivot about pivot point 54.

Figure 10:
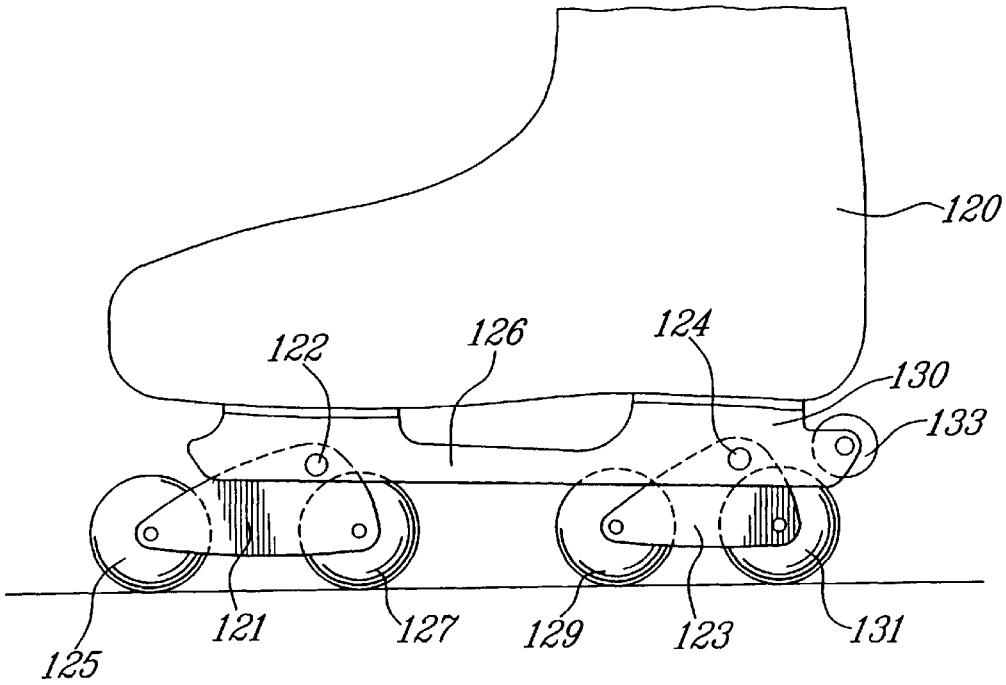
FIG. 10 is an alternative embodiment of an in-line skate further comprising a rear mounted brake.
Figure 11:
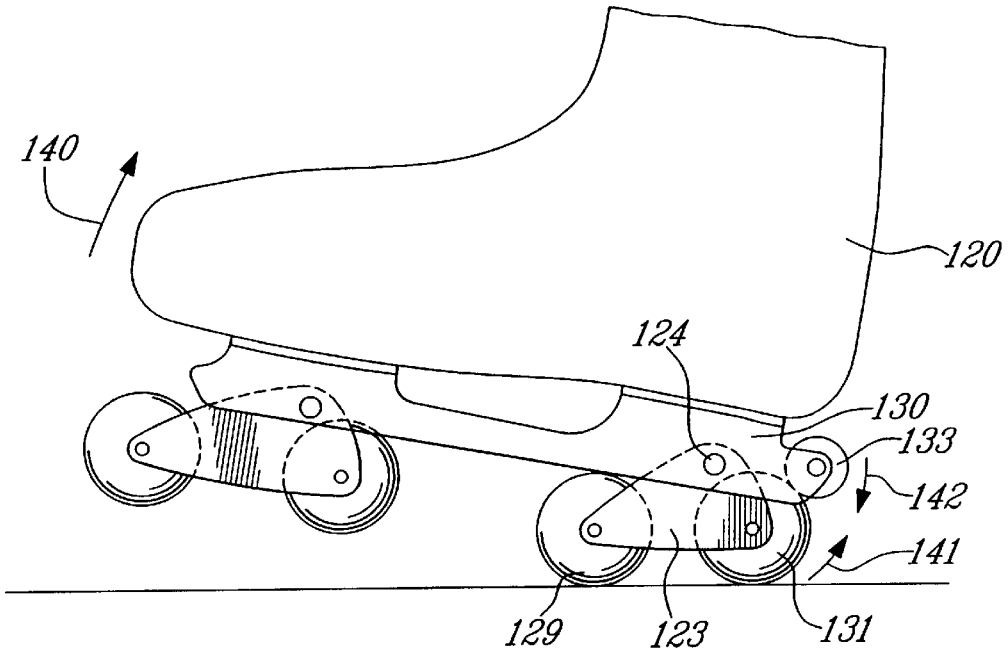
FIG. 11 illustrates the in-line skate of FIG. 10 showing the brake in use.

FIG. 10 is a schematic view of an alternative embodiment of an in-line roller skate 120 fitted with a brake 133 disposed at the rear most portion 130 of sole plate 126. Brake 133 may comprise a cylinder fixedly disposed on sole plate 126 i.e. namely that it is not rotatable. The front wheel frame 121 (equipped with wheels 125 and 127) is attached to the boot 120, by pivot 122. The rear wheel frame 123 (equipped with wheels 129 and 131) is attached to the boot 120, by pivot point 124. As may further be seen in FIG. 10, when the user of an in-line skate 120 desires to brake his or her emotion, the front of the foot, i.e. the front of the boot may be rotated upwardly in the direction of motion arrow 140 such that a relative rotation of the boot 120 and the rear wheel frame 123 equipped with wheels 129, 131, may be caused about pivot point 124. This relative motion i.e. or relative displacement characterised by arrows 141 and 142 will cause wheel 131 to eventually come onto contact with fixed brake 133. This contact will, through frictional engagement of wheel 131 and brake 133, cause skate 122 to slowdown and eventually, if enough friction is generated, to come to a stop.

Figure 12:
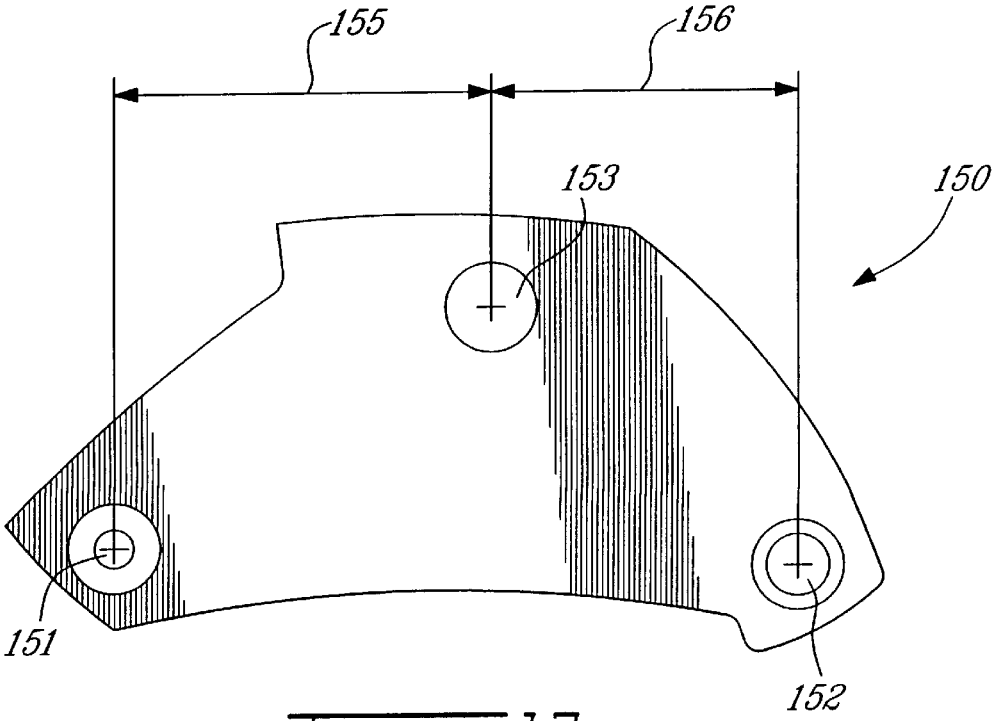
FIG. 12 is an alternative embodiment of a wheel frame shown without wheels rotatably mounted thereon.

FIG. 12 is an alternative embodiment of a wheel frame 150 shown without wheels rotatably mounted thereon. As illustrated, wheel frame 150 comprises a forward or front rotational axis 151 and a rear rotational axis 152, each of which is configured and disposed to accept therein a shaft supporting a wheel (not shown). Wheel frame further comprises a pivot point axis 153, which pivot point axis is configured and disposed to be coupled (i.e. pivotally mounted) to either a sole plate or directly to the underside of a boot. As may be been, the moment arm 155 of the front axis 151 is greater than the moment arm 156 of the rear axis 152.

I claim:

1. An in-line roller skate comprising a boot a sole plate affixed to said boot a first wheel frame having a front wheel and a rear wheel rotatably mounted thereon a second wheel frame having a front wheel and a rear wheel rotatably mounted thereon wherein said first wheel frame is eccentrically, pivotally mounted to said sole plate at a first single pivot point, such that the moment arm of the front wheel about said first pivot point is greater than the moment arm of the rear wheel about said first pivot point, and wherein said second wheel frame is eccentrically, pivotally mounted to said sole plate at a second single pivot point, such that the moment arm of the front wheel about said second pivot point is greater than the moment arm of the rear wheel about said second pivot point.

2. The in-line skate of claim 1 wherein said moment arm of the front wheel of the first wheel frame is the same as said moment arm of the front wheel of the second wheel frame.

3. The in-line skate of claim 1 wherein said sole plate comprises a braking surface configured and disposed to come into frictional braking engagement with said rear wheel of said second wheel frame when said second wheel frame is pivoted to a braking position.

4. The in-line skate of claim 3 wherein said moment arm of the front wheel of the first wheel frame is the same as said moment arm of the front wheel of the second wheel frame.

* * * * *